US006053116A

United States Patent [19]

Jung et al.

[11] Patent Number: 6,053,116

[45] Date of Patent: Apr. 25, 2000

[54] FOLDABLE TABLE

[75] Inventors: Chung Hee Jung; Kun Sik Cho, both of Kyeongki-do, Rep. of Korea

[73] Assignee: Sunmyeng Industry Co., Ltd., Seoul, Rep. of Korea

[21] Appl. No.: 09/285,272

[22] Filed: Apr. 2, 1999

[30] Foreign Application Priority Data

Apr. 4, 1998 [KR] Rep. of Korea ..... 98-5195 U

[51] Int. Cl.[7] ..... A47B 3/00

[52] U.S. Cl. ..... 108/115

[58] Field of Search ..... 108/115, 128, 108/134, 50.11, 162, 166, 171, 179, 167

[56] References Cited

U.S. PATENT DOCUMENTS 5,337,657 8/1994 Diffrient ..... 108/115
5,403,082 4/1995 Kramer ..... 108/115 X
5,622,119 4/1997 Hsieh ..... 108/115
5,644,994 7/1997 Liang et al. ..... 108/115 X

FOREIGN PATENT DOCUMENTS 405337011 12/1993 Japan ..... 108/115

*Primary Examiner*—Jose V. Chen
*Attorney, Agent, or Firm*—Nixon Peabody LLP; Thomas W. Cole

[57] ABSTRACT

A foldable table foldable in a compact configuration for a movement or a storage therefor. The table has an upper support plate, first and second side support plates extending downward from the upper support plate to contact with a floor, an upper pivot plate downward pivotable and hinged to the upper support plate, first and second side pivot plates inward pivotable and hinged to the first and second side support plates, and first and second wing plates formed at the first and second side pivot plates and upward pivotable therefrom. The table is fully folded in a compact configuration when the first and second side pivot plates inward pivot and the upper pivot plate downward pivot.

11 Claims, 7 Drawing Sheets

700

FOLDABLE TABLE

BACKGROUND OF THE INVENTION

1. Field of the Invention

The present invention relates to a foldable table, and more particularly to a foldable table which can be folded in a compact configuration when it is needed to be moved or stored and also can be extended so as to make efficient use of a space.

2. Description of the Prior Art

Recently, various separable or telescopable furniture for improving space utilization has appeared. Such furniture has been developed not only to best utilize the space but also to be easily carried.

Among the separable or telescopable furniture, cabinets, beds, tables or the like are provided in such a manner that their sizes and configurations can be adaptively changed by using various link structures with regard to the spaces where they are to be placed. Alternately, in another type of furniture, adjacent members are hinged to each other so as to be pivot about themselves, thereby varying configurations and sizes. The examples of separable or telescopable furniture are collapsible display tables for displaying merchandises, retractable sofas, foldable tables and benches and extendable tables.

However, the aforementioned conventional furniture has relatively complicated assembling or telescoping mechanisms. Accordingly, when a user carries or stores the furniture after being fully set as designed by the user, a disassembling or a telescoping work, is not easy.

Meanwhile, FIG. 1 shows a conventional extendable table. Referring to FIG. 1, first and second extended portions 4 and 5 can progress outward thereof so as to extend the table and also can retract in an approaching manner therebetween toward a center portion 3 so as to collapse the table while first and second inclined portions 6 and 7 pivot. First and second engaging portions 8*a* and 9 are provided at inner end portions of first and second extended portions 4 and 5 and extend inward of the table. First and second engaging portions 8*a* and 9 guide movements of first and second extended portions 4 and 5. On the other hand, first legs 10 having rollers at their bottoms are respectively secured to corner portions of first engaging portion 8*a,* and second legs 13 are secured to corner portions of second engaging portion 9, thereby supporting the table.

Accordingly, the table provides a relatively wide area thereon when fully extended and provides a compact area thereon when fully retracted.

However, the above table is usable only when it is fully extended or retracted since rollers 11 may slide while being in intermediate positions. Also, the table can not be fully collapsible because legs 10 and 13 remain in protruded positions at all times, so that it is inconvenient for the user to move or store it.

SUMMARY OF THE INVENTION

The present invention is intended to overcome the above described problems. Therefore, the object of the present invention is to provide a foldable table in which upper and both side portions of the tables include fixed and pivot portions respectively so that the table is foldable in a completely folded configuration like a suitcase when each of the pivot portions pivots inwardly with respect to respective fixed portion, and additionally, wings are formed at both side portions for providing additional places on which auxiliary articles can be placed, thereby maximizing a space utilization.

In order to achieve the above object of the present invention, there is provided a foldable table comprising: an upper support plate having an elongated configuration extending in a first direction; first and second side support plates respectively extending downward from undersides of first and second end portions of the upper support plate opposite to each other in the first direction so as to make contact with a bottom; an upper pivot plate downward pivotable about an axis along the first direction with respect to the upper support plate, the upper pivot plate being hinged at an end portion thereof to the upper support plate; first and second side pivot plates inward pivotable about an axis along a second direction perpendicular to the first direction, the first and second side pivot plates being hinged to the first and second side support plates, respectively; and first and second wing plates formed at predetermined portions of the first and second side pivot plates and upward pivotable therefrom, wherein the foldable table is folded in a compact configuration within the upper support plate and the first and second side support plates when the first and second side pivot plates inward pivot by approximately 90 degrees and the upper pivot plate downward pivot by approximately 90 degrees.

The first and second side support plates are secured to the upper support plate and form an inverse-U shape together with the upper support plate.

The first side support plate has a width smaller than a width of the upper support plate by approximately a thickness of the first side pivot plate, the second side support plate has a width smaller than a width of the upper support plate by approximately a sum of thicknesses of the first and second side pivot plates, the first and second side pivot plates making contact at upper ends thereof with an underside of the upper support plate when the second side pivot plate and then the first side pivot plate are sequentially folded, thereby permitting the upper pivot plate to pivot downward.

The first and second side pivot plates are formed with first and second cut portions opened toward the first and second side support plates, respectively, the first and second wing plates having a shape and a size which are identical to a shape and a size of the first and second cut portions and being hinged at upper ends thereof to upper ends of the first and second cut portions, respectively.

The first and second wing plates are maintained at pivoted positions upward from the first and second side pivot plates by an approximately 90 degrees by first and second support rods, respectively, each of which being separately provided and including at least two support rods.

The first and second cut portions are formed at lower corner portions thereof with first and second steps for supporting lower ends of the first and second support rods, respectively, and the first and second wing plates are formed at lower corner portions thereof with first and second recesses for supporting upper ends of the first and second support rods, respectively.

The upper pivot plate is formed at a distal end portion thereof with a couple of projections, and the first and second side pivot plates are formed at top surfaces of distal end portions thereof with a couple of holes, each of the projections being inserted into each of the holes when the upper pivot plate is in a fully upward pivoted position and the first and second side pivot plates are in fully outward pivoted positions, and each of the first and second side pivot plates being provided at an underside thereof with at least two rollers.

According to a preferred embodiment of the present invention, the foldable table further comprises a tray inserted under the upper pivot plate and separable therefrom. A couple of guide rails are mounted at an underside of the upper pivot plate and are spaced apart from each other by a predetermined interval, and the tray is formed at both side portions thereof with flanges, respectively, the flanges being inserted along the guide rails.

According to a preferred embodiment of the present invention, the foldable table further comprises at least one shelf provided between the first and second side pivot plates which are formed at inner surfaces thereof with a plurality of a couple of projections aligned in the second direction.

According to an another embodiment of the present invention, there is provided a foldable table comprising: an upper support plate having an elongated configuration extending in a first direction; first and second side support plates respectively extending downward from predetermined positions at an underside of the upper support plate and spaced apart from each other by a predetermined interval so as to make contact with a bottom; a couple of upper pivot plates downward pivotable about an axis along the first direction with respect to the upper support plate, the upper pivot plates being hinged respectively to both end portions of the upper support plate, the end portions being opposite in a third direction perpendicular to the first direction; first and second side pivot plates each being a couple and inward pivotable about an axis along a second direction perpendicular to both of the first and third directions, each of the first and second side pivot plates being hinged to both sides of each of the first and second side support plates, respectively; and a center plate fixedly engaged between the first and second side support plates, wherein the foldable table is folded in a compact configuration within the upper support plate and the first and second side support plates when the first and second side pivot plates inward pivot by approximately 90 degrees and the upper pivot plates downward pivot by approximately 90 degrees.

BRIEF DESCRIPTION OF THE DRAWINGS

The above object and other advantages of the present invention will become more apparent by describing in detail preferred embodiments thereof with reference to the attached drawings in which.

DETAILED DESCRIPTION OF THE INVENTION

Hereinafter, a preferred embodiment of the present invention will be explained in more detail with reference to FIGS. 2 to 9. Orientations are illustrated with first, second and third directions 901, 902 and 903 in the figures, but they are not confined exactly as shown in the figures, that is, they are shown only for a better illustration. A Cartesian coordinate is used here.

Figure 2:
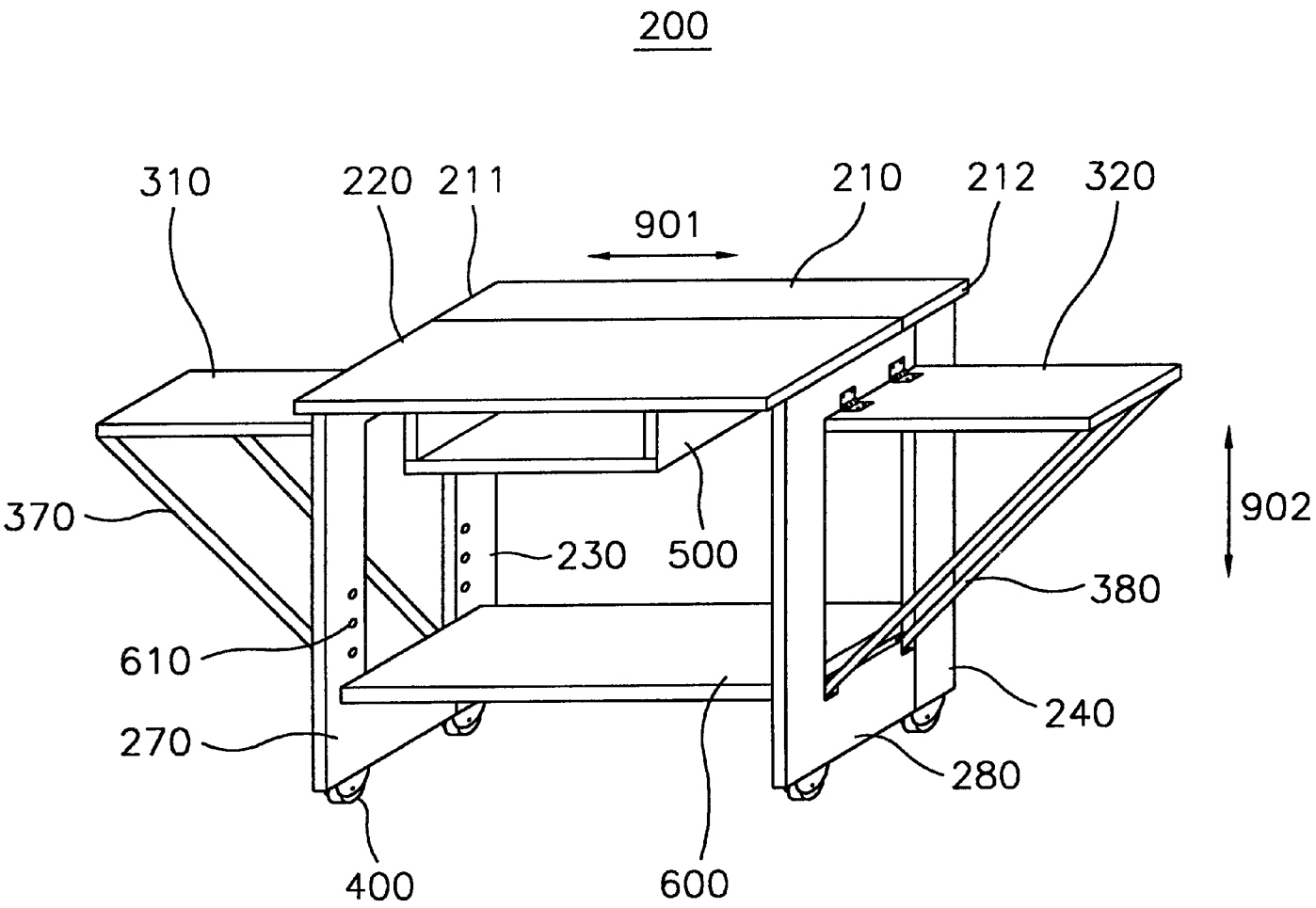
FIG. 2 is a perspective view of a foldable table in accordance with a first embodiment of the present invention.
Figure 3:
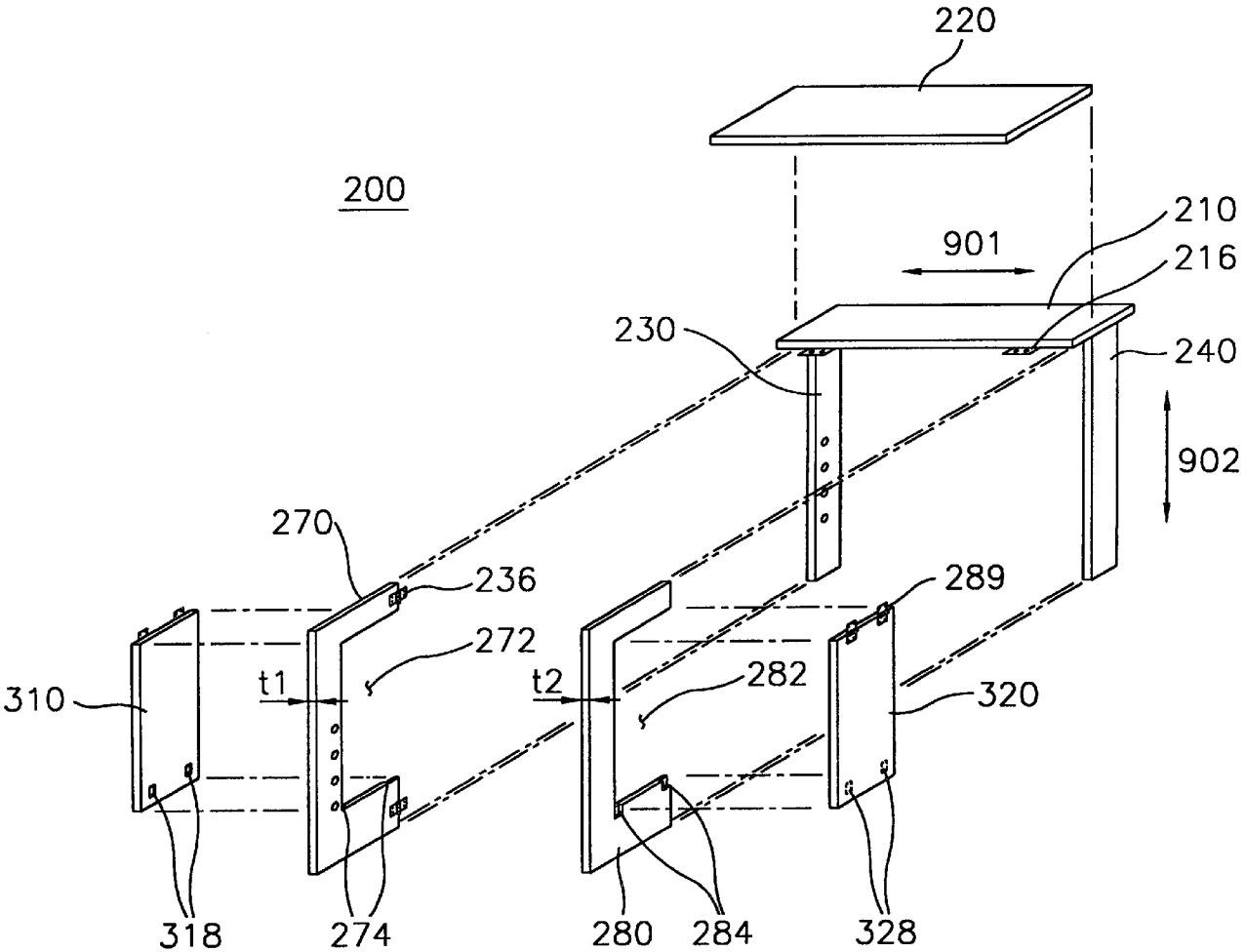
FIG. 3 is an exploded perspective view of the foldable table shown in FIG. 2.
Figure 4:
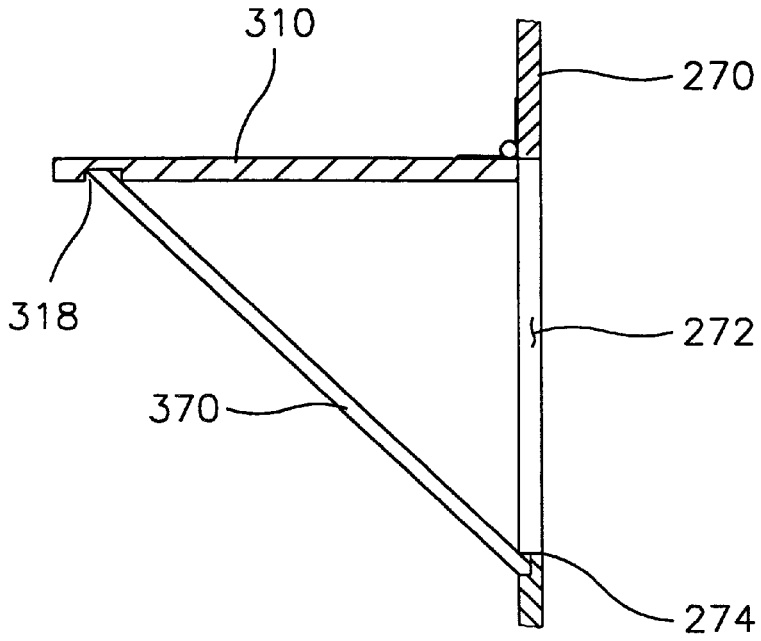
FIG. 4 is a sectional view for illustrating a support structure of a support rod in accordance with the first embodiment.

FIG. 2 shows a foldable table 200 in accordance with a first embodiment of the present invention and FIG. 3 shows an exploded perspective view for the same. Referring to FIGS. 2 and 3, foldable table 200 includes an upper support plate 210 having an elongated at configuration extending in a first direction 901 and first and second side support plates 230 and 240 respectively extending downward from undersides of first and second end portions 211 and 212 of upper support plate 210 opposite to each other in first direction 901 so as to make contact with a bottom, for example, a floor. First and second side support plates 230 and 240 are secured to upper support plate 210 and form an inverse-U shape together with upper support plate 210. An upper pivot plate 220 is hinged at an end portion thereof to upper support plate 210 so as to be downward pivotable about an axis along first direction 901 with respect to upper support plate 210. Referring particularly to FIG. 3, upper support plate 210 and upper pivot plate 220 are assembled by at least two hinges 216.

First and second side pivot plates 270 and 280 are hinged to first and second side support plates 230 and 240 respectively so as to be inward pivotable about an axis along a second direction 902 perpendicular to first direction 901. Also, each of first and second side pivot plates 270 and 280 are assembled to first and second side support plates 230 and 240 by a plurality of hinges 236.

Meanwhile, preferably, first side support plate 230 has a width smaller than a width of upper support plate 210 by approximately a thickness t1 of first side pivot plate 270, and second side support plate 240 has a width smaller than the width of upper support plate 210 by approximately a sum of thicknesses t1 and t2 of first and second side pivot plates 270 and 280. This makes first and second side pivot plates 270 and 280 to contact at upper ends thereof with an underside of upper support plate 210 when second side pivot plate 280 and first side pivot plate 270 are sequentially folded in order, thereby permitting upper pivot plate 220 to pivot downward.

According to the first embodiment, first and second wing plates 310 and 320 are formed at predetermined portions of first and second side pivot plates 270 and 280 and are upward pivotable therefrom. In detail, first and second side pivot plates 270 and 280 are formed with first and second cut portions 272 and 282 opened toward first and second side support plates 230 and 240 respectively. Each of first and second wing plates 310 and 320 is identical to each of first and second cut portions 272 and 282 in shape and size and is hinged at the upper end thereof to the upper end of each of first and second cut portions 272 and 282 respectively.

Figure 1:
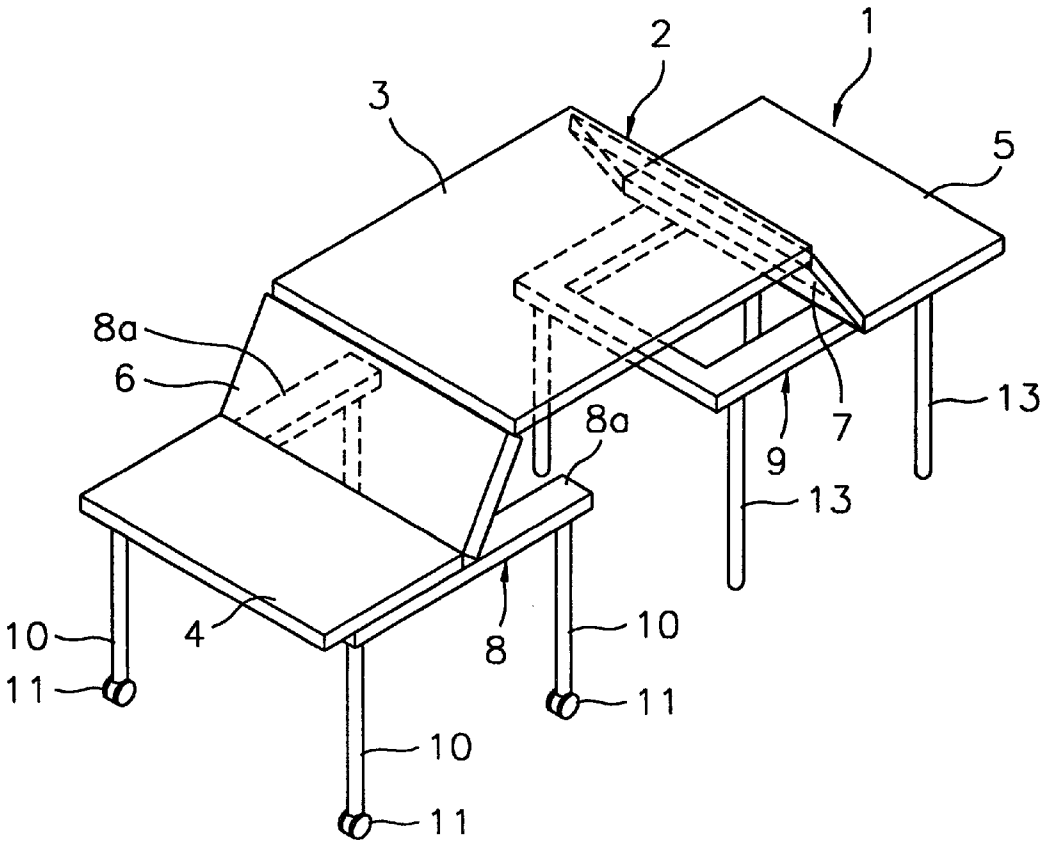
FIG. 1 (PRIOR ART)
FIG. 1 is a perspective view of a conventional extensible table.

Referring now to FIG. 1, first and second wing plates 310 and 320 are maintained at pivoted positions upward from first and second side pivot plates 270 and 280 by approximately 90 degrees by first and second support rods 370 and 380 respectively, each of which being separately provided and including a couple of support rods. According to a preferred embodiment, referring to FIG. 4, first and second cut portions 272 and 282 are formed at lower corner portions thereof with first and second steps 274 and 284 for supporting lower ends of first and second support rods 370 and 380, respectively. Also, first and second wing plates 310 and 320 are formed at lower corner portions thereof with first and second recesses 318 and 328 for supporting upper ends of first and second support rods 370 and 380, respectively.

Figure 5:
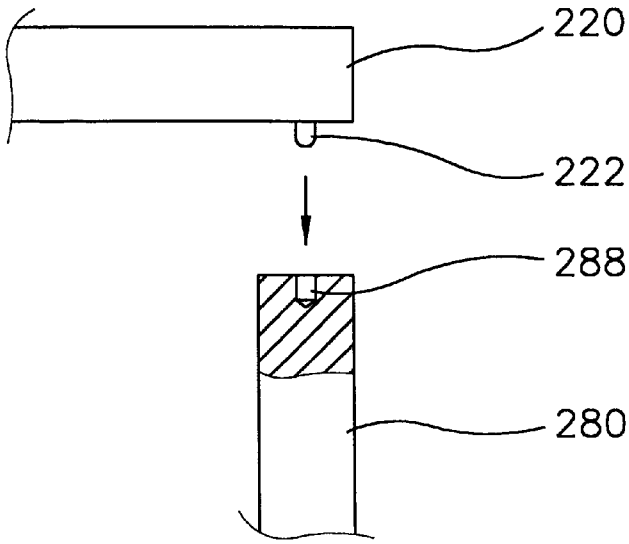
FIG. 5 is a partial sectional view for showing an engaging structure between an upper pivot plate and a first or a second side pivot plate of the first embodiment.

According to a preferred embodiment, referring to FIG. 5, upper pivot plate 220 is formed at a distal end portion thereof with a couple of projections 222, and first and second side pivot plates 270 and 280 are formed at top surfaces of distal end portions thereof with a couple of holes 288. As in FIG. 1, each of projections 222 is inserted into each of holes 288 when upper pivot plate 220 is in a fully upward pivoted position and first and second side pivot plates 270 and 280 are in fully outward pivoted positions. Accordingly, foldable table 200 can maintain its fully extended state.

On the other hand, each of first and second side pivot plates 270 and 280 is provided at an underside thereof with at least two rollers 400, thereby allowing table 200 to slide on the floor.

Figure 6:
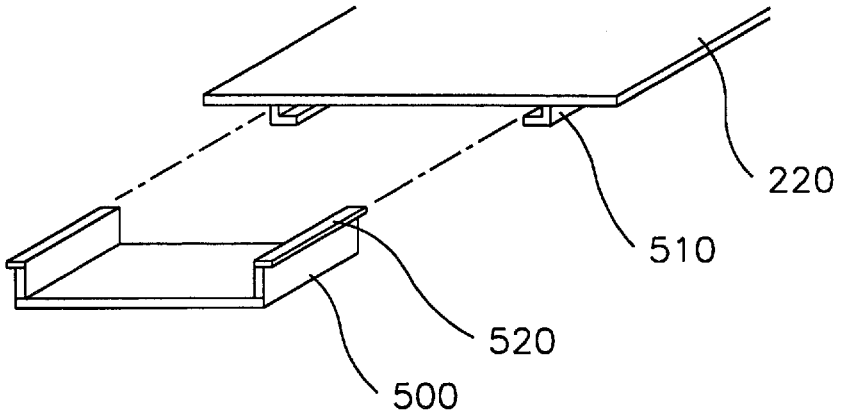
FIG. 6 is a partial exploded perspective view showing a tray in accordance with the first embodiment.

FIG. 6 shows a tray 500 which provides an additional utilizable place. Referring to FIG. 6, tray 500 has an inner space, is inserted under upper pivot plate 220 and is also separable therefrom. A couple of guide rails 510 are mounted at an underside of upper pivot plate 220 and are spaced apart from each other by a predetermined interval. Tray 500 is formed at both side portions thereof with flanges 520, respectively. Flanges 520 slide along guide rails 510 when tray 500 is inserted into or withdrawn from table 200.

According to a preferred embodiment, referring back to FIG. 2, foldable table 200 further comprises at least one shelf 600 provided between first and second side pivot plates 270 and 280 which are formed at inner surfaces thereof with a plurality of a pair of projections 610 aligned in second direction 902. Accordingly, a user can adjust an elevation of shelf 600 at will.

Above described foldable table 200 of the first embodiment serves as a table for a personal computer, for example. A monitor and a desktop of the computer can be placed on upper support plate 210 and upper pivot plate 220, a keyboard in tray 500, and auxiliaries such as a printer and a scanner on first and second wing plates 310 and 320. Also, on shelf 600, various diskettes, compact discs or tools can be placed. However, it is obvious that foldable table 200 can be utilized as other than the computer table, in view of following claim 1.

Figure 7:
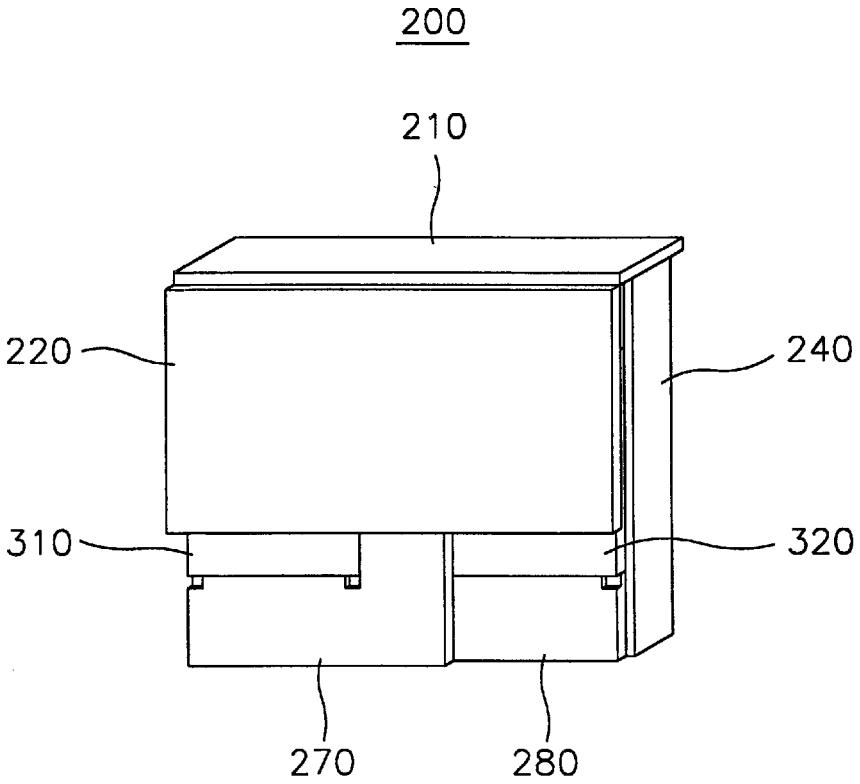
FIG. 7 is a perspective view showing a fully folded state of the foldable table.

FIG. 7 shows a fully folded state of table 200 for a movement or a storage thereof. To accomplish this state, firstly tray 500 and shelf 600 are removed and first and second wing plates 310 and 320 are engaged in first and second cut portions 272 and 282 of first and second side pivot plates 270 and 280. Thereafter, second side pivot plate 280 is folded inward by 90 degrees and then first side pivot plate 270 is folded. Finally, upper pivot plate 220 folded downward, thereby table 200 is folded in a compact configuration within upper support plate 210 and first and second side support plates 230 and 240.

Figure 8:
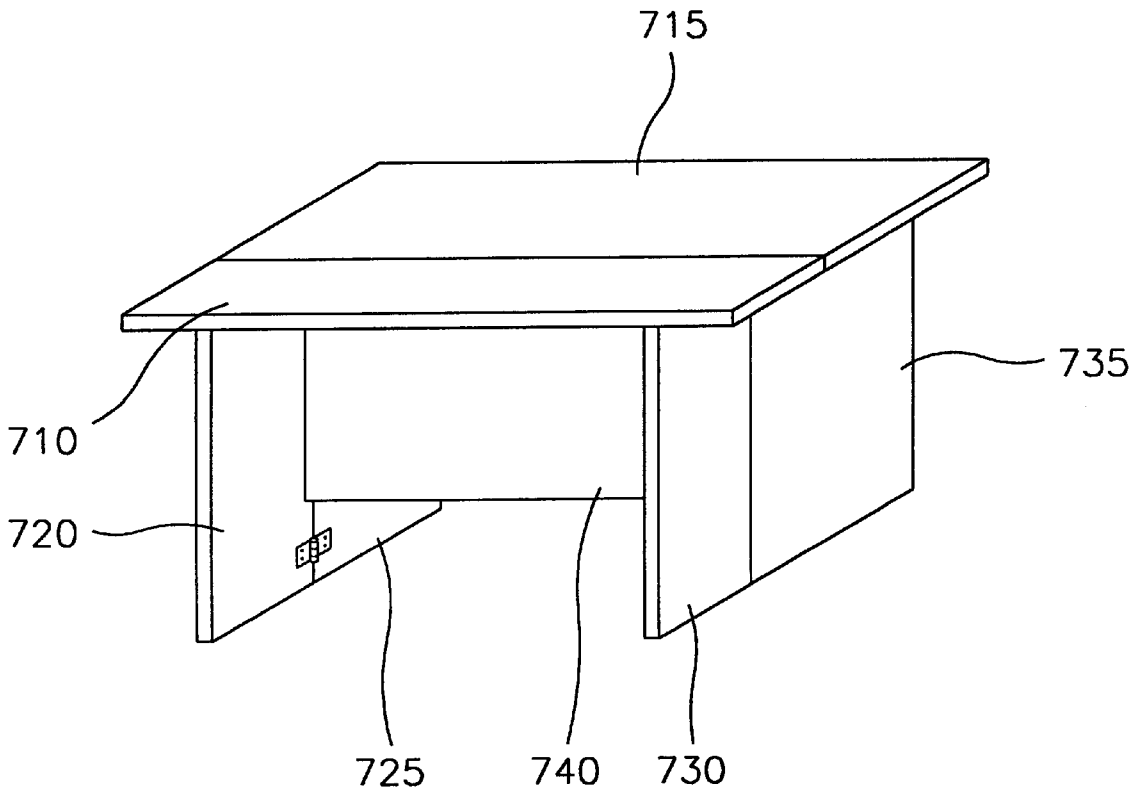
FIG. 8 is a perspective view of a foldable table in accordance with a second embodiment of the present invention.

FIG. 8 shows a foldable table 700 in accordance with a second embodiment of the present invention. Referring to FIG. 8, foldable table 700 is different from table 200 of the first embodiment in that locations of support portions are opposite. That is, an upper support plate 710 and first and second side support plates 720 and 730 are located in a front portion of table 700. In addition, a center support plate 740 is provided therebetween. An upper pivot plate 715 and first and second side pivot plates 725 and 735 extend rearward and form a relatively simple configuration. When it is required to fold table 700, first and second side pivot plates 725 and 735 are folded inward and then upper pivot plate 715 is folded downward, thereby being collapsed in a compact size.

Figure 9:
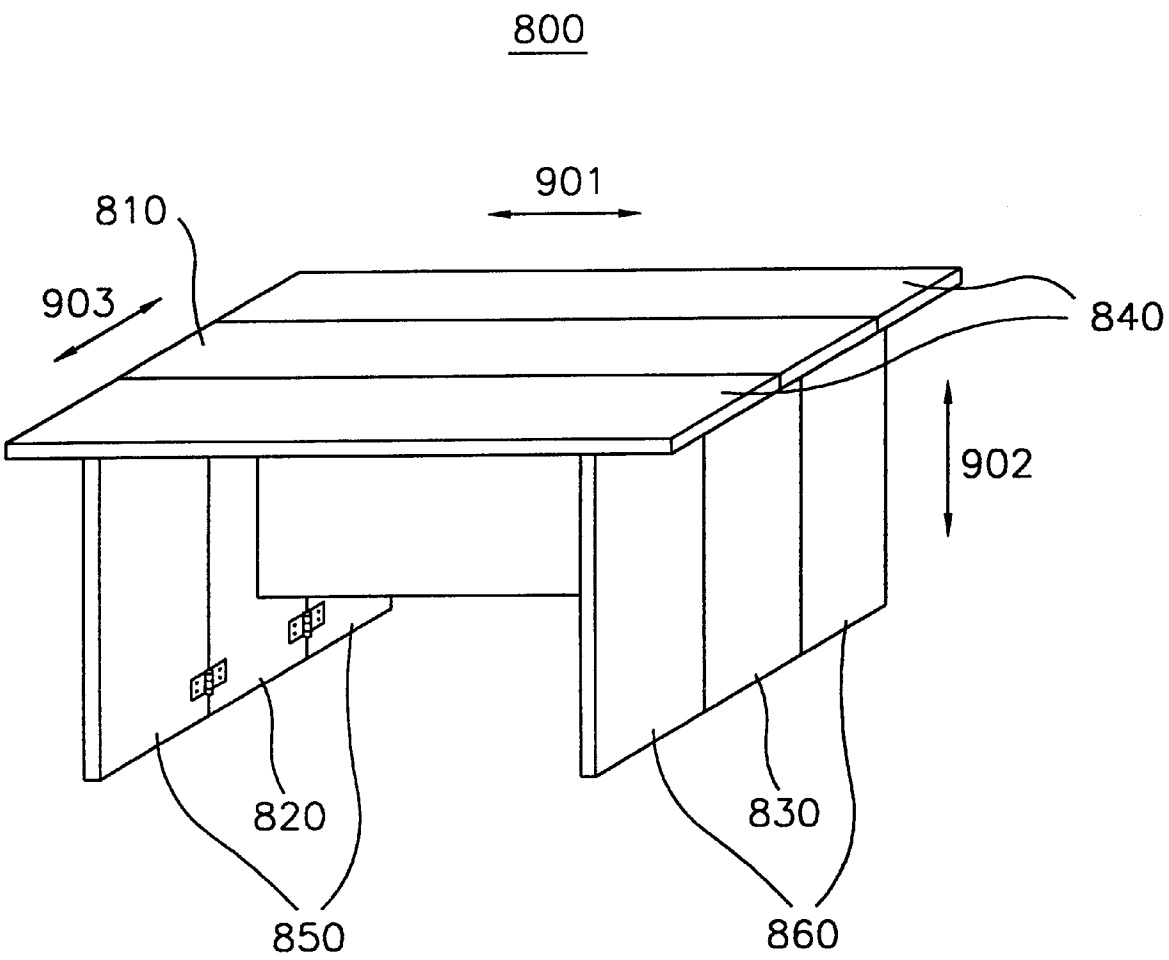
FIG. 9 is a perspective view of a foldable table in accordance with a third embodiment of the present invention.

FIG. 9 shows a foldable table 800 in accordance with a third embodiment of the present invention. Referring to FIG. 9, foldable table 800 includes an upper support plate 810 having an elongated configuration extending in first direction 901 and first and second side support plates 820 and 830 respectively extending downward from predetermined positions at an underside of upper support plate 810 and spaced apart from each other by a predetermined interval so as to make contact with the floor. A couple of upper pivot plates 840 are hinged respectively to both end portions of upper support plate 810, the end portions being opposite in a third direction 903 perpendicular to first direction 901, and are downward pivotable about an axis along first direction 901 with respect to upper support plate 810. Also, first and second side pivot plates 850 and 860 are provided, each of which being a pair. Each of first and second side pivot plates 850 and 860 are hinged to both sides of each of first and second side support plates 820 and 830, respectively, and are inward pivotable about an axis along a second direction 902 perpendicular to both of first and third directions 901 and 903. Foldable table 800 is folded in a compact configuration within upper support plate 810 and first and second side support plates 820 and 830 when first and second side pivot plates 850 and 860 inward pivot by approximately 90 degrees and upper pivot plates 840 downward pivot by approximately 90 degrees.

As described above, the foldable tables in accordance with preferred embodiments of the present invention are characterized in that upper and both side portions of the tables include fixed and pivot portions respectively so that the table is foldable in a completely folded configuration like a suitcase when each of the pivot portions pivots inwardly with respect to respective fixed portion, and additionally, according to the first embodiment, wings are formed at both side portions for providing additional places on which auxiliary articles can be placed, thereby maximizing a space utilization. It is obvious that the foldable tables of the present invention can serve as tables for personal computers, benches, offices and accommodations for picnics.

Although the preferred embodiments of the invention has been described, it is understood that the present invention should not be limited to these preferred embodiments, but various changes and modifications can be made by one skilled in the art within the spirit and scope of the invention as hereinafter claimed.

What is claimed is:

1. A foldable table comprising:

an upper support plate having an elongated configuration extending in a first axial direction and first and second opposed end portions;

first and second side support plates respectively extending downward from the first and second end portions of the upper support plate;

an upper pivot plate pivotable about the upper support plate along the first axial direction;

first and second side pivot plates pivotable about a second axial direction perpendicular to the first axial direction, each of the first and second side pivot plates being hingedly connected to one of the first and second side support plates, respectively; and first and second wing plates formed at predetermined portions within the first and second side pivot plates, each of the first and second wing plates being pivotally connected to one of the first and second side pivot plates respectively;

wherein the foldable table is folded in a compact configuration with the upper support plate and the first and second side support plates by folding the first and second side pivot plates inwardly by approximately 90 degrees and folding the upper pivot plate downwardly by approximately 90 degrees.

2. The foldable table as recited in claim 1, wherein the first and second side support plates are secured to the upper support plate and form an inverse-U shape together with the upper support plate.

3. The foldable table as recited in claim 1, wherein the first side support plate has a width smaller than a width of the upper support plate by approximately a thickness of the first side pivot plate, and the second side support plate has a width smaller than a width of the upper support plate by approximately a sum of thicknesses of the first and second side pivot plates, the first and second side pivot plates making contact at upper ends thereof with an underside of the upper support plate when the second side pivot plate and the first side pivot plate are sequentially folded in order, thereby permitting the upper pivot plate to pivot downward.

4. The foldable table as recited in claim 1, wherein each of the first and second side pivot plates include a cut portion, each of the first and second wing plates being identical to the respective cut portion in a shape and a size and being hinged at an upper end thereof to an upper end to the respective cut portion.

5. The foldable table as recited in claim 4, wherein the first and second wing plates are maintained at pivoted positions upward from the first and second side pivot plates by approximately 90 degrees by a pair of support rods.

6. The foldable table as recited in claim 5, wherein each cut portion is formed at a lower corner thereof with first and second steps for supporting lower ends of the pair of support rods, respectively, and the first and second wing plates are formed at lower corner portions thereof with first and second recesses for supporting upper ends of the pair of support rods, respectively.

7. The foldable table as recited in claim 1, wherein the upper pivot plate has opposed ends and at least one projection located at each of the opposed ends thereof, the first and second side pivot plates each being formed at a top end thereof with at least one hole, each of the at least one projection being inserted into the at least one hole when the upper pivot plate is in a fully upward pivoted position and the first and second side pivot plates are in fully outward pivoted positions, and each of the first and second side pivot plates being provided at a bottom end thereof with at least two rollers.

8. The foldable table as recited in claim 1, further comprising a tray insertable under the upper pivot plate and separable therefrom, the tray having opposed side portions.

9. The foldable table as recited in claim 8, wherein a pair of guide rails are mounted at an underside of the upper pivot plate, the guide rails being spaced apart from each other by a predetermined interval, and wherein the tray is formed at both side portions thereof with flanges, respectively, the flanges being inserted along the guide rails.

10. The foldable table as recited in claim 1, further comprising at least one shelf provided between the first and second side pivot plates, wherein each of the pivot plates include along inner surfaces thereof, a plurality of projections for adjustably supporting said at least one shelf.

11. A foldable table comprising:

an upper support plate having an elongated end configuration extending in a first axial direction and first and second opposed end portions;

first and second side support plates respectively extending downward from predetermined positions of the upper support plate and spaced apart from each other by a predetermined interval;

a pair of upper pivot plates each pivotable about the upper support plate along the first axial direction, each of the upper pivot plates being hinged respectively to one of the end portions of the upper support plate;

a pair of first and second side pivot plates, each of the pivot plates being pivotable about a second axial direction perpendicular to the first axial direction, each of the first and second side pivot plates of each pair being hinged to opposed sides of each of the first and second support plates, respectively; and a center plate fixedly engaged between the first and second side support plates, wherein the foldable table is folded in a compact configuration with the upper support plate and the first and second side support plates by folding the first and second side pivot plates inwardly by approximately 90 degrees and folding the upper pivot plates downwardly by approximately 90 degrees.

* * * * *